United States Patent [19]

Devine, Jr.

[11] Patent Number: 4,689,810

[45] Date of Patent: Aug. 25, 1987

[54] COMPOSITE ROTARY ANODE FOR X-RAY TUBE AND PROCESS FOR PREPARING THE COMPOSITE

[75] Inventor: Thomas M. Devine, Jr., Scotia, N.Y.

[73] Assignee: General Electric Company, Schenectady, N.Y.

[21] Appl. No.: 702,161

[22] Filed: Feb. 15, 1985

[51] Int. Cl.[4] ..... H01J 35/10

[52] U.S. Cl. ..... 378/144; 378/143; 378/127; 378/128

[58] Field of Search ..... 378/127–128, 378/143–144

[56] References Cited

U.S. PATENT DOCUMENTS

| | | | |
|---|---|---|---|
| Re. 31,560 | 4/1984 | Devine, Jr. | 378/143 |
| Re. 31,568 | 4/1984 | Devine, Jr. | 378/143 |
| 3,122,424 | 2/1964 | King | 29/195 |
| 3,442,006 | 5/1969 | Gulchet et al. | 29/472.7 |
| 3,660,053 | 5/1972 | Palme | 29/195 |
| 3,710,170 | 1/1973 | Friedel | 313/330 |
| 3,719,854 | 3/1973 | Sedlatschek et al. | 313/330 |
| 3,819,971 | 6/1974 | Kaplan et al. | 378/144 |
| 3,890,521 | 6/1975 | Shroff | 313/55 |
| 4,004,174 | 1/1977 | Yashiro | 378/144 |
| 4,276,493 | 6/1981 | Srinivasa et al. | 378/125 |
| 4,597,095 | 6/1986 | Akpan | 378/143 |

FOREIGN PATENT DOCUMENTS

| | | |
|---|---|---|
| 7112589 | 8/1972 | Fed. Rep. of Germany . |
| 1383557 | 2/1975 | United Kingdom . |

*Primary Examiner*—Craig E. Church
*Assistant Examiner*—John C. Freeman
*Attorney, Agent, or Firm*—Paul E. Rochford; James C. Davis, Jr.; Paul R. Webb, II

[57] ABSTRACT

Methods for the diffusion bonding of a graphite member to a metallic surface as part of a composite rotary anode for an X-ray tube are set forth. The preferred joint for the composite is made by using a layer of palladium in combination with a layer of metal selected from the group consisting of platinum, osmium, rhodium, ruthenium and alloys thereof.

13 Claims, 5 Drawing Figures

COMPOSITE ROTARY ANODE FOR X-RAY TUBE AND PROCESS FOR PREPARING THE COMPOSITE

BACKGROUND OF THE INVENTION

This application relates to three other patent applications directed to diffusion bonding processes for the preparation of composite high performance rotary anodes for X-ray tubes. These applications, which are incorporated by reference, are U.S. patent applications Ser. No. 702,165 Devine, Jr., filed 2/15/85, Ser. No. 702,164 Devine, Jr., filed 2/15/85 and Ser. No. 702,160 Devine, Jr., filed 2/15/85.

Workers in the field of designing rotary anodes for conventional X-ray imaging systems have long recognized the advantages of utilizing graphite in such constructions. It soon became evident that in using graphite there also exists the danger that when a metallic surface of tungsten, tungsten alloys, molybdenum or molybdenum alloys is in direct contact with graphite, reactions between the metallic surface and the graphite (during manufacture of the rotary target and/or during use thereof to generate the X-ray beam) lead to the formation of a brittle intermediate carbide layer. The patent literature proposes various anode constructions as solutions to this problem, for example, U.S. Pat. Nos. 3,660,053; 3,719,854 and British Pat. Nos. 1,173,859; 1,207,648 and 1,247,244.

Another patent (U.S. Pat. No. 3,890,521) expresses concern with the formation of tungsten carbide by reaction between a graphite disc, or carrier, and the tungsten target layer while accepting the in situ formation of a carbide layer of tantalum (or presumably of hafnium, niobium or zirconium). The initial assembly of components consists of a graphite carrier upon which are successively deposited a first layer of iridium, osmium or ruthenium, a second layer of hafnium, niobium, tantalum or zirconium and then a target layer (e.g., tungsten). The desired layer of carbide (e.g., tantalum carbide) forms when, during operation of the X-ray tube, carbon diffuses across the first layer and reacts with the second layer. Both this patent and U.S. Pat. No. 3,710,170 are concerned with thermal stresses introduced in the rotary anode structure because of the difference in thermal expansion coefficients between tantalum carbide (U.S. Pat. No. 3,890,521) and the adjoining structure and between graphite (U.S. Pat. No. 3,710,170) and the adjoining structure. However, in the case of U.S. Pat. No. 3,710,170, as well as in U.S. Pat. No. 3,890,521, certain metal carbide content is deliberately employed as part of the solder material. For example, in U.S. Pat. No. 3,710,170 it is proposed that a molybdenum-molybdenum carbide eutectic be prepared by placing graphite in contact with molybdenum and heating to about 2200° C.

Still another concern is evident in British Pat. No. 1,383,557 wherein a solder layer of zirconium and/or titanium is employed to join graphite to molybdenum, tantalum or an alloy formed between two or more of tungsten, molybdenum, tantalum and rhenium. A carbide layer is formed between the graphite support and the solder layer. Particular temperature control and initial foil thickness are employed to insure survival of the solder layer.

The great variance in thought in the preceding prior art as to how to best join graphite to refractory metals, particularly tungsten, tungsten alloys, molybdenum and molybdenum alloys shows how complex this problem has remained in the design of rotary anodes for conventional X-ray apparatus.

These varied solutions to the extent they may be viable in conventional X-ray imaging systems, face a much more severe test in connection with the use of graphite members in X-ray tubes used in medical computerized axial tomography (C.A.T.) scanners. In the formation of images, a medical C.A.T. scanner typically requires an X-ray beam of from 2 to 8 seconds in duration. Such exposure times are much longer than the fractions-of-a-second exposure times typical for conventional X-ray imaging systems. As a result of these increased exposure times, much larger quantities of heat (generated as a by-product of the process of X-ray generation in the target region) must be stored and eventually dissipated by the rotating anode.

Graphite, which provides a low mass, high heat storage volume, remains a prime candidate, of course, for inclusion in rotating anode structures for C.A.T. scanner X-ray tubes, particularly when the graphite member functions as a heat sink from which heat is dissipated as radiant energy as is disclosed in U.S. Pat. No. 3,710,170 and U.S. Pat. No. Re. 31,568 rather than as support for the target anode layer.

One important consideration in the manufacture of a composite anode disc embodying a graphite member is the method by which the graphite is bonded to an adjacent tungsten, tungsten alloy, molybdenum or molybdenum alloy metallic surface. Formation of any brittle carbide layer is of particular concern, because of the propensity thereof for cracking. Cracking results in a reduction in heat flow from the metal surface to the adjacent graphite member and frequently will compromise the structural integrity of the anode.

In X-ray tubes used in C.A.T. scanners, the bulk temperatures of such anode reach temperatures of 1200°-1300° C. in operation. At such temperatures, tungsten, tungsten alloys, molybdenum or molybdenum alloys readily form the undesired metal carbide. Thus, it has been considered particularly important for such rotary anodes to devise a joining procedure and anode structure in which the metallic surface is not permitted to react with the graphite and, even more important, that provision is made in the composite anode structure to prevent reaction from occurring between the metallic surface and the graphite during operation of the C.A.T. scanner X-ray tube.

Three reissue patents (U.S. Pat. Nos. Re. 31,369; Re. 31,560 and Re. 31,568) issued to Thomas M. Devine, Jr., describe a brazing procedure in which a layer of platinum, palladium, rhodium, osmium, ruthenium or platinum-chromium alloy is interposed between the metallic surface and the graphite body to which it is to be joined. Although a brazed region develops above and below the interposed layer, this layer itself survives to function as a barrier to carbon diffusion during operation of the X-ray tube. The aforementioned braze materials are characterized by their ability to react with tungsten, tungsten alloys, molybdenum, molybdenum alloys and also with graphite. Because the reaction of the interposed layer with graphite can only proceed at a temperature in excess of the temperatures that are reached by the rotating anode in service, even at the maximum service temperatures an intermediate platinum layer, for example, will act as a diffusion barrier for carbon to prevent the passage thereof through the platinum, where it would be able to form the brittle tungsten or molybdenum carbide.

The use of alloys of platinum to join graphite to tungsten or tungsten alloy is disclosed in Gebrauchmuster #7,112,589 and the use of alloys containing platinum to join graphite to tungsten or molybdenum is disclosed in U.S. Pat. No. 3,442,006. In both of these inventions the process for joining requires that the intermediate layer be melted. An intermediate layer of any of the alloys proposed in U.S. Pat. No. 006 would fail as a diffusion barrier to carbon at X-ray anode operating temperatures.

Provided that the brazing in the practice of the aforementioned Devine inventions is accomplished quickly, formation of the objectionable carbide is avoided. At the brazing temperatures employed, which render the intermediate layer (e.g., platinum) molten, the intermediate molten layer can become saturated with carbon. By way of example, liquid platinum can, over a period of time at a temperature just above the eutectic temperature, dissolve up to about 16 atomic percent carbon. When tungsten or molybdenum is in contact with such a high carbon content liquid, carbide will form at the interface. The amount of time available for the carbon to dissolve in the liquefied braze layer is, therefore, important and if the assembly being brazed remains at a high temperature for too long a period of time, a thick layer of carbide can form, which layer is in danger of becoming cracked during cooling or handling. In the case of the use of platinum as the braze layer to affix molybdenum to graphite, a temperature exposure of about 1800° C. for as little as about 5 minutes will result in a layer of molybdenum carbide about 0.003 inch in thickness.

Therefore, in the practice of the process disclosed in the Devine reissue patents, if brazing capability is available at the manufacturing facility to provide fast ramping to brazing temperature, holding for a short time and then cooling to below 1400° C. in a brief time frame, carbide formation is avoided. However, such ideal heating arrangements, which are commercially available, may not be accessible and it may be necessary to use a larger furnace. A problem that will occur when a number of rotary anode discs (typically 4 or 5 inches in diameter) are processed simultaneously in a furnace of high thermal mass is that each such disc tends to stay hot for a relatively long period of time and thick, cracked layers of carbide can form. Consequently, as an alternative to the aforementioned brazing method, it would be desirable to have a joining technique and anode composition, which can tolerate having the anode discs spend a finite length of time (e.g., minutes) at the joining temperature (and thereby permit the use of furnaces of high thermal mass) and the rotary anodes produced from such composites will be able to render high quality performance in the rigorous environment of the C.A.T. scanner X-ray tube.

As was discovered in connection with the invention described in Ser. No. 702,165 filed 2/15/85, whereas workers in the art have consistently sought to totally avoid the formation of brittle tungsten carbide or molybdenum carbide layers in the joint bonding a graphite body to a metal component of tungsten, tungsten alloy, molybdenum or molybdenum alloy in a rotary anode, what is important is not the presence or absence of such carbide layers, but the thickness thereof and the assurance that such carbide layers will not increase in thickness during use of the composite.

This condition is achieved in the diffusion bonding process of Ser. No. 702,165 filed 2/15/85 by applying certain temperature-time-applied stress relationships to an assembly consisting of the above metal component, a graphite body and an intervening continuous layer of a metal selected from the group of platinum and platinum alloys.

DESCRIPTION OF THE INVENTION

Initial efforts in which palladium was substituted for the platinum or platinum alloy layer of Ser. No. 702,165 filed 2/15/85, instead of producing a thin carbide layer as expected, formed a joint between molybdenum and graphite that was free of carbide. In place of a thin carbide layer, most of the thickness of the original layer of palladium was converted to a zone of interdiffused molybdenum and palladium. This composite construction is yet to be evaluated and although the joint appears to be sound it still remains to be seen how such a composite will stand up to testing under stress.

Additional efforts in which a layer of platinum was used together with the palladium layer has provided a more interesting composite construction. Thus, the assembly included, in sequence, a molybdenum body, a layer of platinum, a layer of palladium and a graphite member. By subjecting this assembly of elements to diffusion bonding employing the temperature-time-applied stress relationships defined herein, a joint was formed between the molybdenum and the graphite that was different from, and is expected to be stronger than, the joint formed when platinum alone or palladium alone is used. Instead of producing a relatively thick zone of interdiffused metals (as with palladium alone) or a thin continuous layer of carbide (as with platinum alone), the palladium/platinum system resulted in discrete patches of thin carbide ($Mo_2C$) between the surviving platinum layer and the molybdenum. The advantage of this controllably producible result is that, if for some reason, any of the discreet carbide patches develops a laterally extending crack, the crack can propogate no further than that carbide patch. Further, direct metallurgical bonding between the adjacent platinum and molybdenum surfaces will occur in the areas common to these surfaces (i.e., between the carbide patches). The surviving layers of palladium or palladium and platinum in both the above-described constructions function as effective barriers to the transport of carbon at anode operating temperatures.

In the case in which palladium alone is disposed between mating surfaces of the metal component (i.e., molybdenum, molybdenum alloy, tungsten, tungsten alloy) and the graphite body the resulting joint includes a zone of interdiffused metals comprising palladium and metal from the metal component and a continuous layer of palladium metallurgically bonded to the zone of interdiffused metals. This joint is metallurgically bonded to the adjacent metal component and graphite body and is expected to form a sound laminated composite of use in the preparation of a rotary X-ray anode.

The compound laminate joint produced from the assembly employing adjacent layers of platinum and palladium, the latter being adjacent the graphite body, includes (1) the discontinuous layer of discrete patches of carbide of metal from the metal component (the carbide patches being metallurgically bonded to the surface of the metal component); (2) an interdiffusion layer of platinum and atoms from the metal component, this interdiffusion layer being metallurgically bonded both to the patches of carbide and to the surface of the metal component contacted thereby, (3) a surviving continuous carbon-barrier layer of platinum metallurgically bonded to an interdiffusion layer on each side thereof, (4) an interdiffusion layer of platinum and palladium and (5) a continuous surviving carbon-barrier layer of palladium metallurgically bonded to the platinum-palladium interdiffusion layer and to the graphite body. This joint construction should be particularly useful as part of composite rotary anodes for X-ray tubes.

The diffusion bonding is conducted in an atmosphere inert to the assembled elements for about 4–5 minutes at temperatures ranging from about 1400° C. to 1500° C. (i.e., no melting of the palladium) with stress applied generally normal to the joining interfaces. The applied stress should be of a magnitude at least sufficient to bring, and maintain, adjacent elements in intimate enough contact to enable atoms to diffuse across the interface. The requisite applied stress to achieve good bonding depends on the finishes of the mating surfaces of the members. The lower the stress employed, the smoother the mating surfaces should be. At an applied stress of 2000 psi, sound joints can be produced using the aforementioned times and temperatures without any need for special surface preparation. Also, in general, when using palladium foil (or palladium and platinum foils), the applied stress must be higher than when the metal(s) is electroplated or vapor deposited.

BRIEF DESCRIPTION OF THE DRAWINGS

The features of this invention believed to be novel and unobvious over the prior art are set forth with particularity in the appended claims. The invention itself, however, as to the organization, method of operation and objects and advantages thereof, may best be understood by reference to the following description taken in conjunction with the accompanying schematic drawings wherein:

MANNER AND PROCESS FOR MAKING AND USING THE INVENTION

The palladium or platinum metal used in the practice of this invention should have a purity of at least about 99.5%, this purity being commercially available. Such grades are soft and extremely ductile. Palladium alloys (i.e., palladium is the major constituent by weight) and platinum alloys (or alloys of other substitutes for platinum) in which the alloying addition does not destroy the ability of the layer to function as a barrier to carbon transit during operation of the anode (e.g., platinum with 1% by weight chromium) may also be used. The ability of a given alloy to meet this criterion can be routinely determined.

Although platinum (and platinum alloys) has been the only metal specifically mentioned hereinabove as useful together with palladium or palladium alloys, it is expected that osmium, rhodium, ruthenium and alloys of the aforementioned (although much more expensive) can be substituted for platinum.

The platinum or platinum alloy layer may be supplied as a foil or may be vapor deposited on the metal component being joined to the graphite body.

The total thickness of the initial layers of palladium (or palladium alloy) and platinum (or platinum alloy) should be in the range of from about 0.002" to about 0.004".

Figure 1:
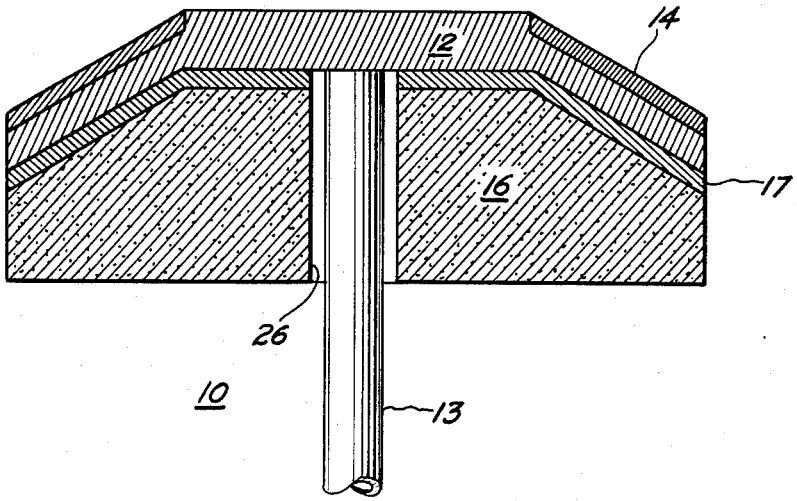
FIG. 1 is a view predominantly in cross-section of a composite rotary anode construction prepared in accordance with the process described herein.

Referring now to FIG. 1, there is shown a composite rotary anode 10 prepared by the method of this invention in which disc (also referred to as a support, or carrier) 12, preferably made of molybdenum or molybdenum alloy, is joined to stem 13 by brazing, welding, diffusion bonding and the like. Disc 12, which supports anode target 14 affixed to a selected surface area of the outer surface thereof, is diffusion bonded to graphite member 16 via the joint 17 present in the completed structure.

Figure 3:
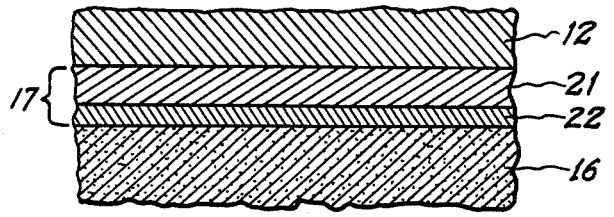
FIG. 3 is an enlarged view of the joint between the graphite body and the molybdenum or tungsten component to show in greater detail the makeup of the joint produced during the diffusion bonding wherein a layer of palladium alone is used as the joint-producing medium.

As is shown in FIG. 3, joint 17 produced using palladium (or palladium alloy) alone as the joint-producing medium is made up of, in sequence, a layer 21 of interdiffused metals comprising palladium and metal from disc 12 and continuous layer 22 comprising palladium or palladium alloy. Each of these two laminae are metallurgically bonded to adjoining surfaces. Layer 22 and zone 21 may each contain small amounts of carbon dissolved therein. When zone 21 is made up of molybdenum and palladium its composition can be represented as $Mo_xPd_y$ indicating a range of compositions.

Because of the presence of palladium layer 22 in the completed assembly to function as a barrier to carbon diffusion, no carbide layer can develop during operation of the X-ray tube even under the conditions of operation of a medical C.A.T. scanner.

Figure 4:
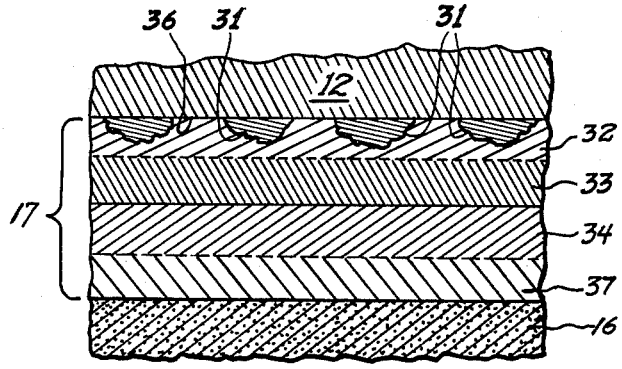
FIG. 4 is an enlarged view as in FIG. 3 to show the compound laminate produced when palladium together with platinum are the joint-producing media and FIG. 5 is a flow diagram defining essential steps employed in the preferred mode for preparing the composite rotary anode constructions of this invention.

In FIG. 4 the make-up of joint 17 is shown when a continuous layer of palladium or palladium alloy is used in combination with a continuous layer of metal selected from the group consisting of platinum, osmium, rhodium, ruthenium and alloys thereof. In this embodiment joint 17 consists of thin, discontinuous carbide layer 31, interdiffusion layer 32 of platinum (or substitute therefor) and metal atoms from the metal component 12, layer 33 of platinum (or substitute therefor), interdiffusion layer 34 of palladium and platinum (or substitute therefor) and layer 36 of palladium or palladium alloy. Each of these layers is metallurgically bonded to adjoining surfaces. In the case of layer 32, this layer is bonded both to the spaced patches of carbide comprising layer 31 and to surface areas 36 of disc 12. The carbide patches are composed of carbide(s) of the carbide-forming metal component(s) of disc 12, e.g., $Mo_2C$. Layers 32, 33, 34 and 37 each contain small amounts of carbon dissolved therein.

The relationships of temperature, time and applied stress for producing optimum composites are routinely determinable from the teachings set forth herein. Additional aspects useful in the optimization of the diffusion bond are component part surface finish, thickness of the palladium and platinum layers, cleanliness and freedom from initial stress.

Graphite member 16 is provided with an aperture (the wall of which is designated by numeral 26) enabling stem 13 to be bonded directly to metal disc 12. Sufficient space is maintained between the surface of stem 13 and wall 26 of the graphite member to obviate the formation of carbides in the metal of stem 13.

The material of anode target 14 typically comprises tungsten, an alloy of tungsten and rhenium, and the like. When the material of anode target 14 is an alloy of tungsten and rhenium, the rhenium content typically varies from 3 to 10 weight percent but may be as high as 25 weight percent.

Graphite member 16 contributes the favorable features of high heat storage and high heat dissipating capability. As shown, disc 12 is saucer-like in configuration and the matching surface of the heat sink, graphite member 16, is similarly contoured.

A powdered metallurgical technique may be employed to form disc 12 and anode target 14 as a unit. In such case, a predetermined amount of the powder metal material provided to constitute the anode target 14 is placed in a die. The molybdenum (or molybdenum alloy, tungsten or tungsten alloy) powder to constitute disc 12 is then added to the die and the powder metals are compressed to form a unified green compact. The green compact is then sintered and hot forged to produce the disc/target combined structure. It is at this point in the manufacturing process that graphite member 16 is diffusion bonded to the underside of support disc 12 as described herein. Thereafter, stem 13 is joined to disc 12 by inertia welding, brazing, diffusion bonding and the like. The stem material is preferably columbium or a columbium alloy. Preferably stem 13 is hollow to reduce heat conduction along its length.

Figure 2:
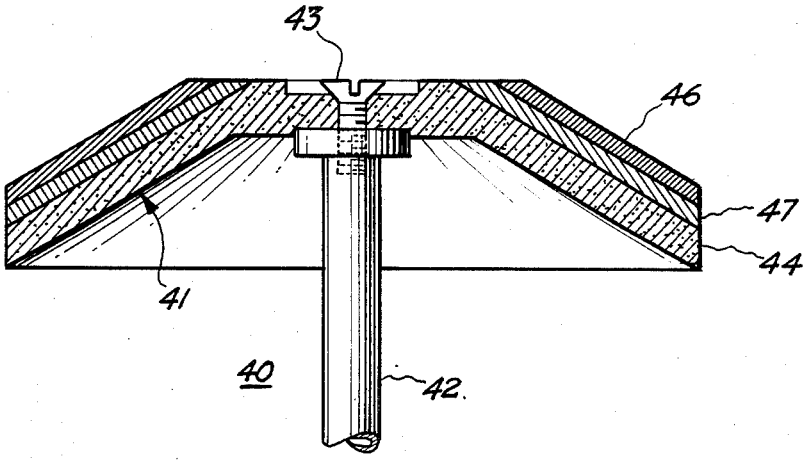
FIG. 2 is a view in cross-section in large part of another embodiment of a composite rotary anode construction prepared according to the process of this invention.

A second configuration of a composite rotary anode employing a graphite member is shown in FIG. 2. The completed composite rotating anode 40 includes a disc assembly 41 joined to stem 42 by means of screw assembly 43. Disc assembly 41 comprises the saucer-like configured graphite disc 44 and preformed annular shaped anode target 46 diffusion bonded thereto via the joint 47. Joint 47 in the completed composite has the construction described for joint 17 in FIG. 3 (i.e., layer 21 and layer 22) and in FIG. 4 (i.e., layer 31, layer 32, layer 33, layer 34 and layer 37) having the compositions generally described hereinabove, but in which the metal to which the graphite is to be bonded is tungsten or a tungsten alloy.

The palladium or palladium alloy layer may be provided in the form of a foil, preferably about 0.002 inch thick, by electroplating or by vapor depositing (e.g., sputtering) the palladium on the graphite. Further, palladium foil may be used in combination with a palladium layer provided by either of the other deposition processes. If such multiple layers of palladium or palladium alloy are used, they become metallurgically bonded together during the diffusion bonding step but are distinguishable as layers, because of differences in microstructure.

The target anode 46 of tungsten or tungsten-rhenium alloy is joined to the graphite substrate 44 by positioning target 46 over graphite member 44 with the palladium (or palladium alloy) and platinum (or substitute) layers disposed therebetween. These component elements are urged into close abutting contact by the application of stress thereto to enable the diffusion of atoms across the interfaces during the subsequent diffusion bonding, which is preferably conducted in vacuum. Other inert atmospheres, such as hydrogen or argon can be used.

Figure 5:
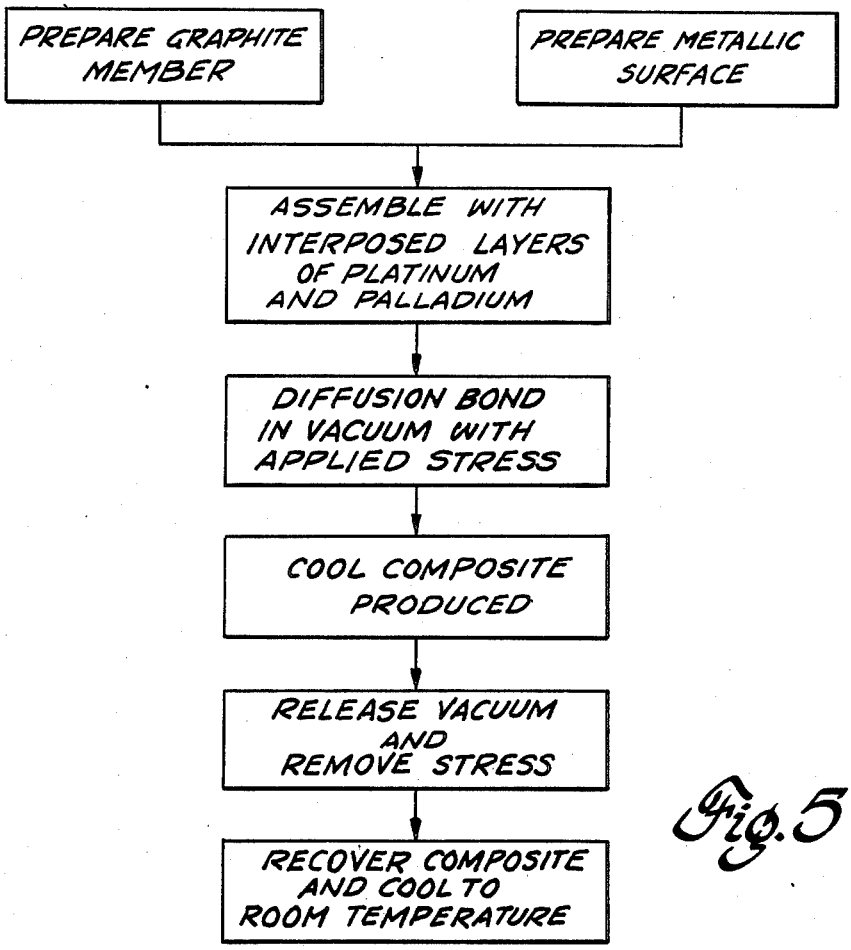

The process of joining the graphite member to a metallic surface [either the metal disc 12 (FIG. 1 embodiment) or the metal target layer 46 (FIG. 2 embodiment)] according to the preferred joint construction of this invention is briefly outlined in the flow diagram of FIG. 5.

Various preliminary steps may be taken in the preparation of (a) the graphite member, (b) the metallic surface, (c) the layer of palladium or palladium alloy and (d) the layer of platinum (or substitute therefor). Thus, in the case of the graphite, in addition to the forming thereof in the desired shape, the graphite body may be subjected to ultrasonic cleaning and/or thermal shock. In the case of the metallic surface of tungsten, tungsten alloy, molybdenum or molybdenum alloy, the component presenting this metallic surface may be subjected to stress relief anneal, etching and/or ultrasonic cleaning in an organic solvent. The exposed surface of electroplated (or vapor deposited) palladium or palladium alloy and/or electroplated (or vapor deposited) platinum insure adequate contact with the metallic surface. Such improved contact may be obtained by grinding and polishing or by lap finishing the surface(s).

After the graphite member and metallic surface have been prepared for assembly they are disposed in a "sandwich" arrangement with at least one layer of palladium or palladium alloy (e.g., a palladium foil, an electroplated layer of palladium or a combination of electroplated palladium with a palladium disc) and a layer of platinum or platinum alloy (e.g., as a foil) therebetween. The assembled components are placed in a heating chamber in which a vacuum can be drawn with the platinum (or substitute) layer next to the metallic surface. Stress is applied to the assembly to urge the components of the assembly into intimate contact, the extent of applied stress depending upon the surface finishes of the mating parts. The vacuum is now drawn. The assembled components, while under the applied stress, are heated, preferably by radiation, in the vacuum environment to the desired temperature for the preselected period of time. This constitutes the diffusion bonding process. After completion of the diffusion bonding step, the heating is stopped and the sample is permitted to cool. When the temperature of the unified composite reaches approximately 300° C., air can be admitted to the chamber, the stress on the diffusion-bonded composite is reduced to zero and the composite is removed and permitted to cool to room temperature (i.e., about 68°–72° F.).

In the following examples the metal component to which the graphite is diffusion bonded was a molybdenum alloy (TZM) containing about 0.5 w/o of titanium and about 0.1 w/o of zirconium. Room temperature is 68°–72° F.

EXAMPLE 1

An assembly was prepared for diffusion bonding in which a foil of palladium (0.002" thick) was placed between a piece of TZM and a piece of graphite. This assembly was subjected to a stress of 2000 psi normal to the interface and was diffusion bonded by heating over a 9 minute period to 1400° C.; the 1400° C. temperature was held for 4 minutes; the unified assembly was permitted to cool to about 300° C. over a period of one hour and then was rapidly cooled to room temperature by air blasting followed by water spraying. Subsequent metallograhic inspection of the interface established freedom from carbide, but a palladium-molybdenum intermetallic phase(s) had formed between the surviving palladium layer (significantly thinner than its original 0.002" thickness) and the TZM body.

EXAMPLE 2

In this assembly a layer of palladium (foil 0.002" thick) was joined by a layer of platinum (foil 0.002" thick). The platinum was placed adjacent the TZM body and the palladium was located between the platinum and the graphite body. The assembly was subjected to a stress of 2000 psi normal to the interface and was diffusion bonded by heating over a 10 minute period to about 1410° C.; the 1410° C. temperature was held for about 4 minutes and was then permitted to cool to about 300° C. (about one hour). Thereafter the unified assembly was rapidly cooled to room temperature by the use of air blasting followed by water spraying. Subsequent metallograhic inspection of the interface indicated that it was free of any intermetallic phase, but a non-continuous layer of $Mo_2C$ had formed at the platinum-molybdenum interface. The presence of an interdiffusion layer (i.e., layer 34) of platinum and palladium was also observed. A second interdiffusion layer (i.e., layer 32 of molybdenum and platinum) was not observed, but is to be inferred.

Improved results in the diffusion bonding can be obtained by subjecting the molybdenum or molybdenum alloy component to stress relief annealing in vacuum at 1650° C. for about half an hour and/or etching by direct immersion for 30 seconds in a solution of 12 gm KOH+12 gm $K_3Fe(CN)_6$ per 100 ml. of $H_2O$ to remove surface oxide scale. Just prior to assembly and diffusion bonding it is preferred to subject all component elements to ultra-sonic cleaning in acetone for several minutes.

Diffusion bonding was performed inside a cylindrically-shaped vacuum chamber measuring 24 inches in diameter by 21 inches in height. Samples were heated by radiation emitted from a graphite susceptor ($\frac{3}{4}$ in. thick$\times 4\frac{1}{2}$ in. high$\times$4 in. inside diameter) which was inductively heated. Assemblies to be diffusion bonded were placed on a graphite block which extended $1\frac{1}{2}$ inches up inside of the graphite susceptor. Assembly temperatures were measured optically. Stresses were applied to the assemblies either by means of a hydraulic ram, which entered through a water-cooled O-ring seal at the top of the vacuum chamber, or by placing molybdenum and/or graphite weights on top of the assembly. In a typical test the desired stress was first applied to the sample, the chamber was then pumped down to a pressure of $\sim 100\mu$, and 20 kW of power was passed through the copper induction coil. Once the assembly reached the desired temperature, the power was reduced to maintain an approximately constant temperature in the assembly for a given period of time. After the assembly was at temperature for the desired length of hold time, power to the induction coil was shut off. Each test sample was allowed to cool for 1 hour, at which point its temperature was approximately 300° C. Air was admitted into the chamber, the stress on the assembly was reduced to zero and the unified assembly was removed and permitted to cool to room temperature. To inspect the joint for soundness each sample was then sectioned in half longitudinally and the sectioned surface was metallographically polished and etched. The joints appeared to be sound.

A combination of optical microscopy and energy dispersive X-ray analysis were employed and it was determined thereby that intermetallic phases of molybdenum-palladium were present in the sample of Example 1.

In summary, the tabulated results indicate that TZM (and thereby molybdenum) can be diffusion bonded to graphite using an intermediate layer of palladium (or palladium alloy) alone or intermediate layers of palladium (or palladium alloy) and metal selected from the group consisting of platinum, osmium, rhodium, ruthenium and alloys thereof. In the latter arrangement a discontinuous layer of carbide of predetermined maximum thickness is formed. In both arrangements the formation of carbide during operation of the X-ray anode is prevented. In the carbide-forming arrangement, if bonding temperatures in the range of 1400° C.–1500° C. for 4–5 minutes are used, the thickness of carbide layer 31 will be kept to less than about 1.0 micrometers. The applied stress required for good bond depends on the surface finishes of mating parts. The lower the stress used, the smoother the mating surfaces must be. At an applied stress of 2000 psi, sound joints can be produced without any need for special surface preparation. With an 8–10 root mean square (RMS) finish on the platinum and metal surfaces, good bonding can be achieved with an applied stress of only 5 psi. Porosity of the graphite results in its rough surface. In order to insure bonding over the entire graphite surface contiguous with the palladium layer, a high stress (about 2000 psi) should be applied when a 0.002 inch thick palladium foil or platinum foil is used. If a low stress is to be used, the palladium layer should be electroplated onto the graphite in order to fill the graphite pores. As an alternative method, the palladium may be deposited by vapor deposition, such as vacuum sputtering.

When graphite is to be diffusion bonded to tungsten or tungsten alloys instead of molybdenum or molybdenum alloys, the temperature/time/applied stress relationships described herein are equally applicable.

In claiming this invention reference to a layer of a metal or alloy thereof shall be understood to encompass either a single layer or contiguous multiple layers thereof, because the function remains the same for the multiple layers as for the single layer.

What is claimed is:

1. In an anode assembly for a rotating anode for an X-ray tube wherein a graphite body is joined to the surface of a metal component of said anode assembly, the metal of said metal component being selected from the group consisting of molybdenum, molybdenum alloys, tungsten and tungsten alloys, the improvement wherein the joint between said graphite body and the surface of said metal component is crack-free and comprises, in sequence, a discontinuous layer of discrete patches of carbide comprising carbide of metal from said metal component metallurgically bonded to said metal component; a first interdiffusion layer comprising metal from said metal component and metal selected from the group consisting of platinum, osmium, rhodium, ruthenium and alloys thereof; said first interdiffusion layer being metallurgically bonded to said carbide patches and to said metal component over areas of contact therewith; a first carbon-barrier layer consisting essentially of metal selected from the group consisting of platinum, osmium, rhodium, ruthenium and alloys thereof; a second interdiffusion layer of metal selected from the group consisting of platinum, osmium, rhodium, ruthenium and alloys thereof and metal selected from the group consisting of palladium and palladium alloys; said second interdiffusion layer being metallurgically bonded to said first carbon-barrier layer and a second carbon-barrier layer consisting essentially of metal selected from the group consisting of palladium and palladium alloys; said second carbon-barrier layer being metallurgically bonded both to said second interdiffusion layer and to said graphite body.

2. The improvement of claim 1 wherein the second carbon-barrier layer has a thickness of about 0.002 inch.

3. The improvement of claim 1 wherein the first carbon-barrier layer is platinum.

4. The improvement of claim 1 wherein the first carbon-barrier layer is platinum—1 wt % chromium alloy.

5. The improvement of claim 1 wherein the metal of the metal component is a molybdenum alloy containing small amounts of titanium and zirconium.

6. The improvement of claim 1 wherein the graphite body is joined to a disc of molybdenum or molybdenum alloy on the underside thereof relative to the anode target of the X-ray anode.

7. The improvement of claim 1 wherein the metal of the metal component is molybdenum.

8. The improvement of claim 1 wherein the metal of the metal component is tungsten.

9. The improvement of claim 1 wherein the graphite body is the disc of the X-ray anode.

10. The improvement of claim 1 wherein the layer of carbide is less than about one micrometer thick.

11. The improvement of claim 1 wherein the metal of the second carbon-barrier layer is palladium.

12. The improvement of claim 1 wherein the metal of the metal component is a tungsten alloy.

13. The improvement of claim 12 wherein the tungsten alloy is tungsten-rhenium alloy.

* * * * *